US010245712B2

(12) United States Patent
Chien

(10) Patent No.: US 10,245,712 B2
(45) Date of Patent: Apr. 2, 2019

(54) RATCHET WRENCH HAVING QUICK RELEASE STRUCTURE

(71) Applicant: YIH CHENG FACTORY CO., LTD., Nantuo (TW)

(72) Inventor: Chih-Hung Chien, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 300 days.

(21) Appl. No.: 15/185,101

(22) Filed: Jun. 17, 2016

(65) Prior Publication Data

US 2017/0361436 A1 Dec. 21, 2017

(51) Int. Cl.
*B25B 23/00* (2006.01)
*B25B 13/46* (2006.01)
*B25B 13/48* (2006.01)

(52) U.S. Cl.
CPC ..... *B25B 23/0028* (2013.01); *B25B 13/46* (2013.01); *B25B 13/461* (2013.01); *B25B 13/481* (2013.01)

(58) Field of Classification Search
CPC ..... B25B 23/0028; B25B 13/461
USPC ..... 81/58.3, 177.8
See application file for complete search history.

(56) References Cited

U.S. PATENT DOCUMENTS 4,063,473 A * 12/1977 Bozzo ..... B67B 7/0441 29/434
8,424,845 B2 * 4/2013 Cole ..... B25D 1/045 254/22
8,757,032 B2 * 6/2014 Shu-Ju ..... B25G 1/063 81/177.8
2005/0016332 A1 * 1/2005 Hu ..... B25B 13/465 81/177.8
2007/0163402 A1 * 7/2007 Hsieh ..... B25G 1/063 81/177.9
2007/0283790 A1 * 12/2007 Cheng ..... B25G 1/063 81/177.9
2009/0000430 A1 * 1/2009 Wu ..... B25B 13/08 81/177.8
2010/0058896 A1 * 3/2010 Abel ..... B25B 13/461 81/60
2015/0360352 A1 * 12/2015 Chen ..... B25B 13/461 81/177.8

* cited by examiner

*Primary Examiner* — Joseph J Hail
*Assistant Examiner* — Henry Y Hong
(74) *Attorney, Agent, or Firm* — Chun-Ming Shih; HDLS IPR Services

(57) ABSTRACT

A ratchet wrench having a quick release structure includes a drive bar, a rotary head, and a locking switch. The drive bar includes a fork arm, a fork opening formed at the fork arm, an axial hole communicating with the fork opening, and a radial hole communicating with the axial hole. The rotary head is pivotally connected to two ends of the fork arm. The rotary head includes a round housing, a plurality of positioning recesses disposed on the round housing, and a pivot axis passing through the rotary head. The pivot axis is perpendicular to the radial hole. The locking switch includes a turning element disposed in the radial hole and a latch element disposed in the axial hole. The turning element rotatably drives the latch element to move axially, and the latch element is engaged with or released from any positioning recess.

14 Claims, 12 Drawing Sheets

RATCHET WRENCH HAVING QUICK RELEASE STRUCTURE

TECHNICAL FIELD

The present invention relates to a ratchet wrench and, in particular, to a ratchet wrench having a quick release structure, whereby a rotary head is released to rotate freely by rotating a turning element by a small angle.

BACKGROUND

The ratchet wrench is a common hand tool for tightening operations. The ratchet wrench can be used flexibly and can move back and forth freely to tighten or loosen blots, nuts, or the likes, so it replaces a traditional wrench in many situations.

The ratchet wrench includes a head portion, a bar extending outwardly from the head portion, and a drive head disposed on the head portion. The drive head is drivingly associated with objects, e.g. nuts and bolts, by means of a variety of sleeves in different sizes. A user simply needs to hold the bar to swing it, and the objects can be loosened or tightened. However, the conventional ratchet wrench is often limited by a dead corner or a tiny space, and thereby the drive head of the ratchet wrench cannot fasten the objects smoothly. In solution, there is a ratchet wrench with a drive head rotatable with respect to the bar. However, the ratchet wrench with the rotatable drive head has a complicated structure for fixing the drive head, and its inconvenient operations cannot meet the market's expectations.

SUMMARY

It is an object of the present invention to provide a ratchet wrench having a quick release structure, which is easy to operate and has a simple structure.

Accordingly, the present invention provides a ratchet wrench having a quick release structure, comprising a drive bar, a rotary head, and a locking switch. The drive bar includes a fork arm, a fork opening formed at the fork arm, an axial hole communicating with the fork opening, and a radial hole communicating with the axial hole. The rotary head is pivotally connected to two ends of the fork arm. The rotary head includes a round housing, a ratchet apparatus disposed inside the round housing, a plurality of positioning recesses disposed on the round housing, and a pivot axis passing through the rotary head and the two ends of the fork arm. The pivot axis is perpendicular to the radial hole. The locking switch includes a turning element disposed in the radial hole and a latch element disposed in the axial hole. The turning element rotatably drives the latch element to move axially, and the latch element is engaged with or released from any of the positioning recesses.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
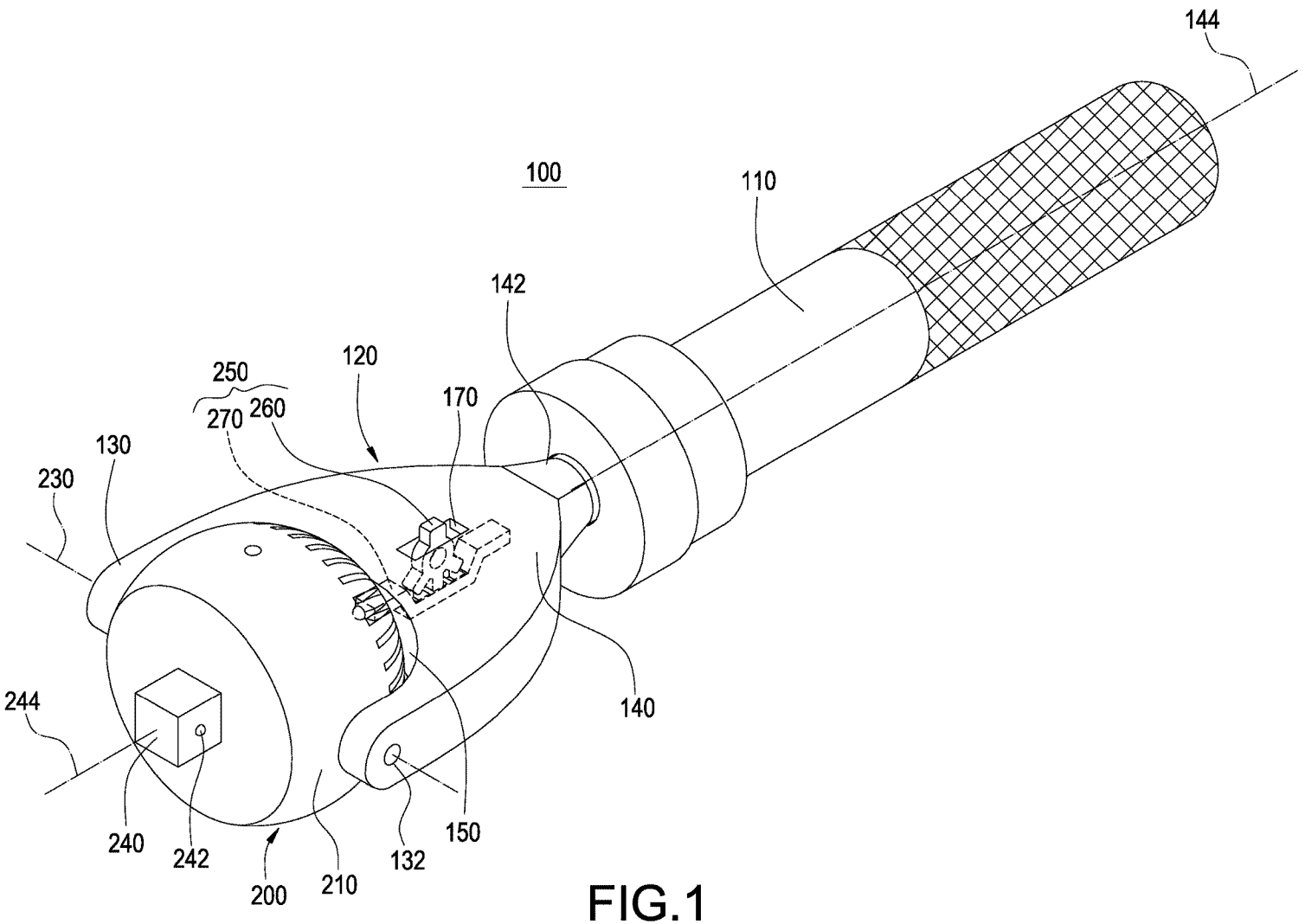
FIG. 1 is a perspective view according to a first preferable embodiment of the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 6, the present invention provides a ratchet wrench 100 having a quick release structure, comprising a drive bar 120, a rotary head 200 and a locking switch 250. In the present embodiment, the ratchet wrench 100 preferably further includes an operation handle 110 for receiving the drive bar 120. By quickly rotating the operation handle 110 when the ratchet wrench 100 is in an upright state or by moving back and forth the operation handle 110 when the ratchet wrench 100 is in a horizontal state, the rotary head 200 tightens or loosens an object (not illustrated).

The drive bar 120 includes a fork arm 130, a fork opening 150 formed at the fork arm 130, an axial hole 160 communicating with the fork opening 150, and a radial hole 170 communicating with the axial hole 160. As shown in the drawing, the fork arm 130 includes two forks (not labelled); the fork opening 150 is formed between the two forks. The rotary head 200 is pivotally connected to two ends of the fork arm 130. The rotary head 200 includes a round housing 210 and a ratchet apparatus (not illustrated) disposed inside the round housing 210, a plurality of positioning recesses 220 disposed on the round housing 210, and a pivot axis 230 formed at the rotary head 200 and passing through the two ends of the fork arm 130, wherein the pivot axis 230 is perpendicular to the radial hole 170.

The rotary head 200 further includes an output element 240 in a rectangular shape protruding from one end of the round housing 210, a positioning ball 242 at one side surface of the output element 240, and a ratchet apparatus (not illustrated) connected to the rectangular output element 240. Moreover, the ratchet apparatus is disposed inside the round housing 210, and a variety of sleeves (not illustrated) in different sizes can be engagedly assembled by means of the positioning ball 242 of the output element 240, so that the object can be tightened or loosened. The ratchet apparatus is a conventional apparatus, so a detailed description thereof is omitted for brevity.

In the present embodiment, the drive bar 120 further includes two supporting bolts 132, an enlarged end 140 and a bar body 142. The supporting bolts 132 are inserted through the two ends of the fork arm 130 respectively and are fixed between the round housing 210 and the fork arm 130. The pivot axis 230 is an imaginary line passing through an axle center of each supporting bolt 132, so that the rotary head 200 is freely rotatable about the pivot axis 230 at the fork opening 150 to some certain angles, e.g. from 0 to 270 degrees. The enlarged end 140 is disposed between the fork arm 130 and the bar body 142. A size of the enlarged end 140 is greater than a size of the bar body 142. The axial hole 160 and the radial hole 170 are preferably disposed in the enlarged end 140. In other words, the locking switch 250 is also disposed in the enlarged end 140, and therefore the ratchet wrench 100 of the present embodiment has better strength and provides superior operation quality.

Furthermore, in the present embodiment, the positioning recesses 220 at least include a first positioning recess 222 disposed on a top of the round housing 210 and a second positioning recess 224 disposed at each of two opposite sides of the round housing 210. The first positioning recess 222 and the second positioning recess 224 preferably form an included angle of 90 degrees therebetween, so that a user can operate the ratchet wrench 100 in an upright state, i.e. a central axis 244 of the output element 240 is parallel to a rotation axis 144 of the drive bar 120, or alternatively in a horizontal state, i.e. the central axis 244 of the output element 240 is perpendicular to the rotation axis 144 of the drive bar 120. The rotation axis 144 is preferably a central line of the drive bar 120 and/or the operation handle 110.

The positioning recess 220 is preferably in a shape corresponding to the shape of a latch element 270, e.g. an arc shape or other suitable shape, so that the latch element 270 can be engaged with or released from any of the positioning recesses 220 easily.

The locking switch 250 includes a turning element 260 disposed in the radial hole 170 and a latch element 270 disposed in the axial hole 160. The turning element 260 rotatably drives the latch bar 270 to move axially, so that the latch element 270 is engaged with or released from any of the positioning recesses 220. In the present embodiment, the locking switch 250 includes a locking spring 280 connected to one end of the latch element 270, and the other end of the latch element 270 is axially movable with respect to the locking spring 280 to be engaged with or released from any of the positioning recesses 220. The locking spring 280 preferably includes, but is not limited to, a compression spring.

Figure 2:
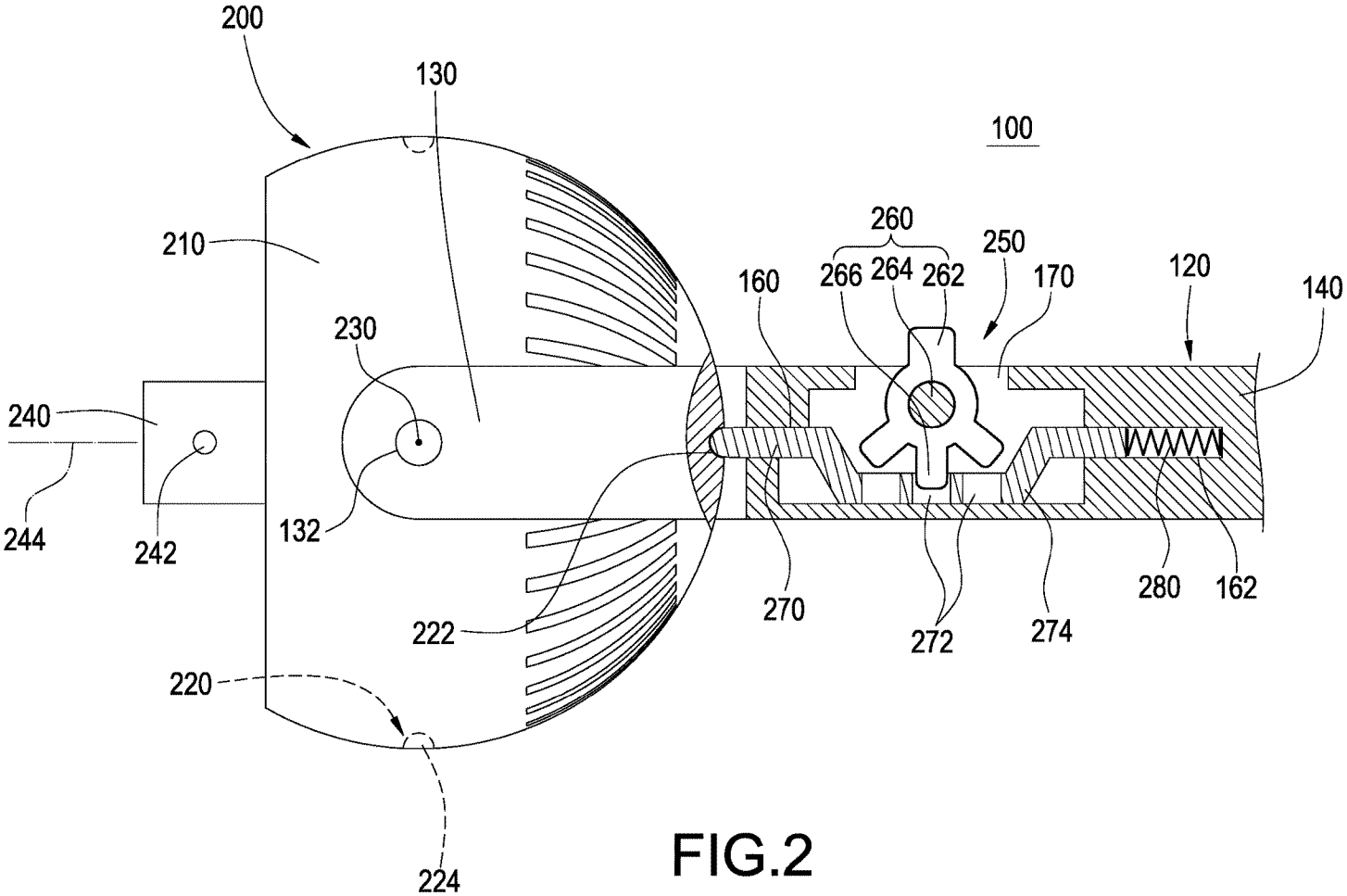
FIG. 2 is a cross-sectional view according to the first preferable embodiment of the present invention.
Figure 4:
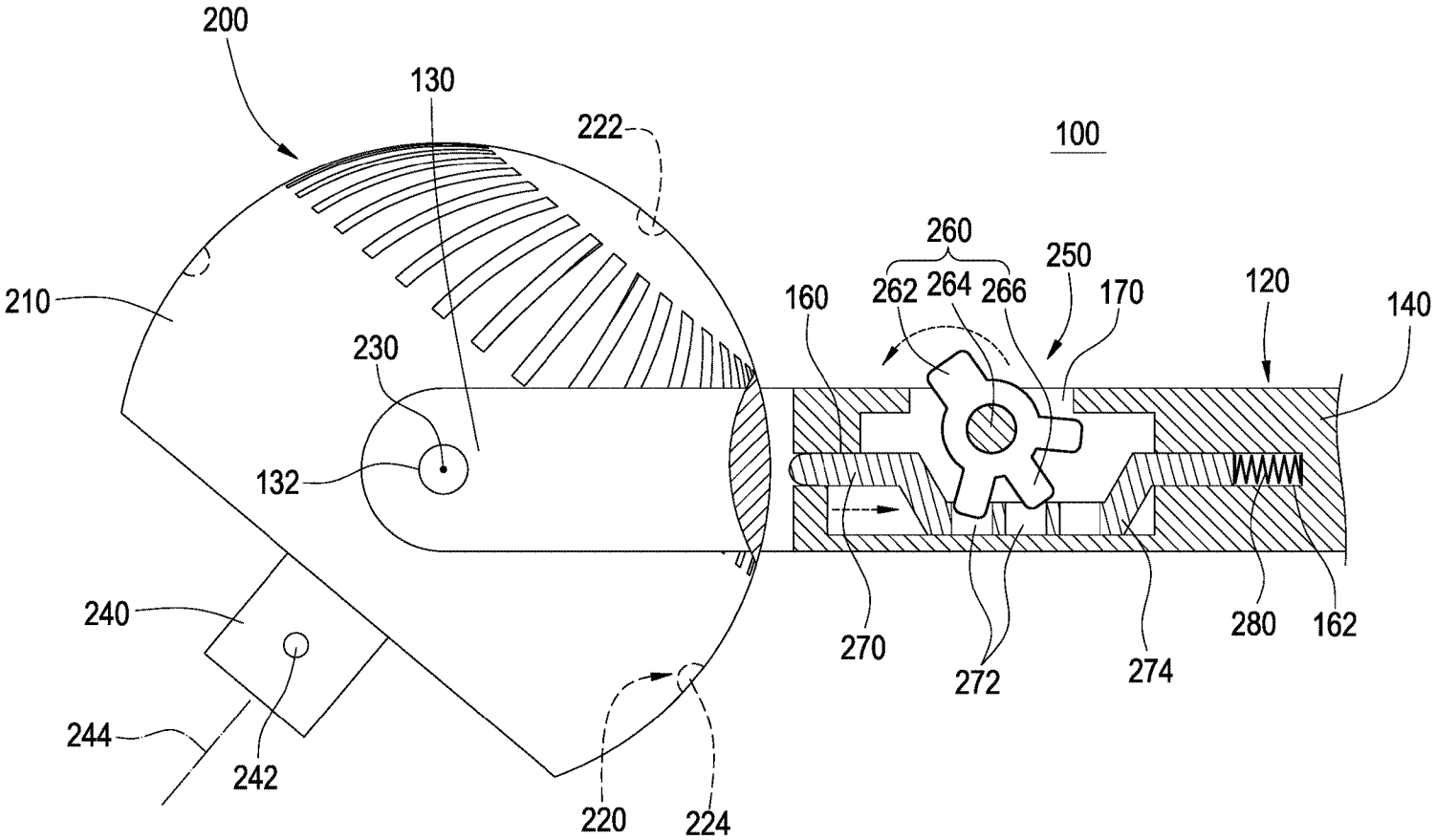
FIG. 4 is a cross-sectional view of FIG. 3.
Figure 5:
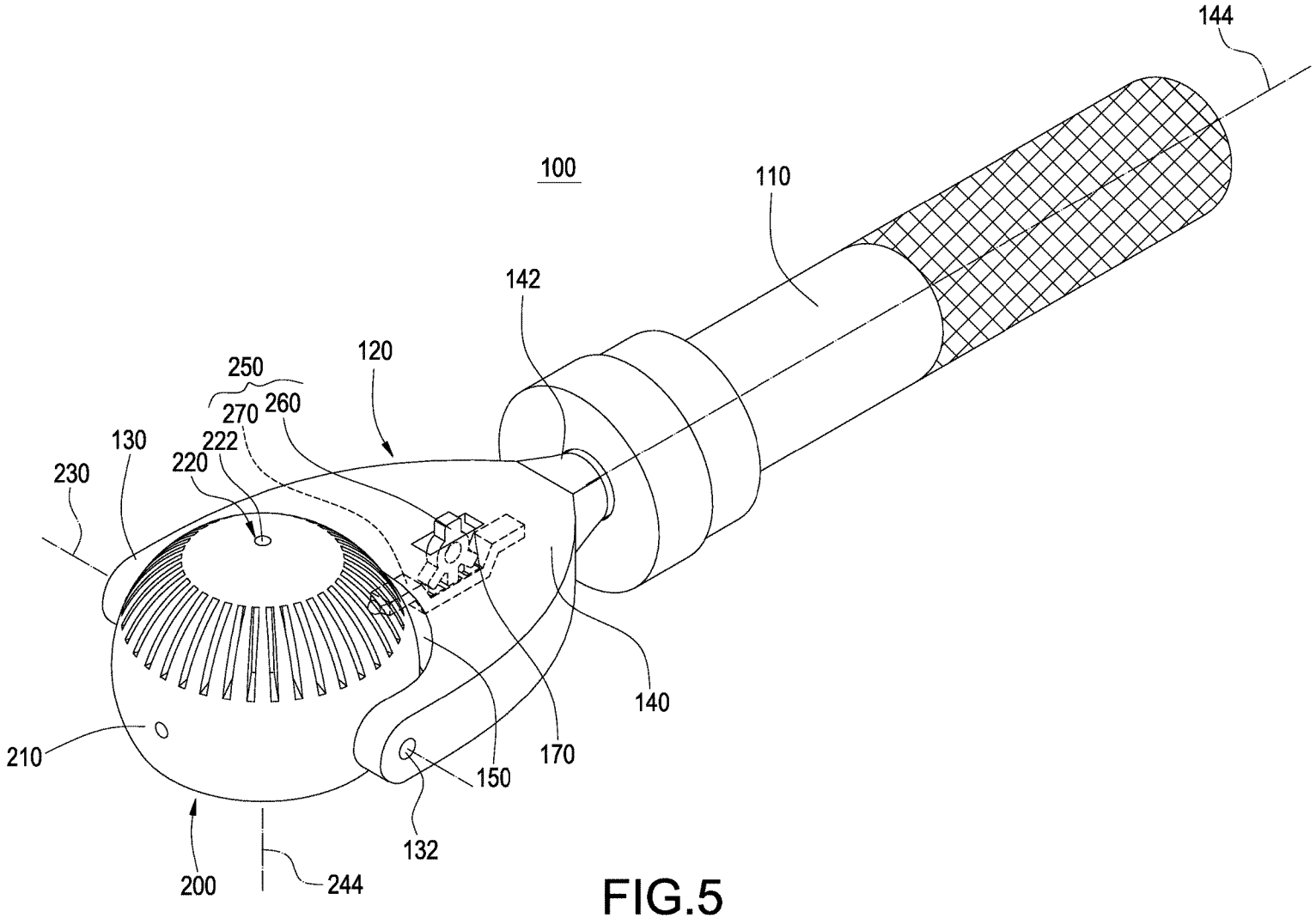
FIG. 5 is another perspective view according to the first preferable embodiment of the present invention.
Figure 6:
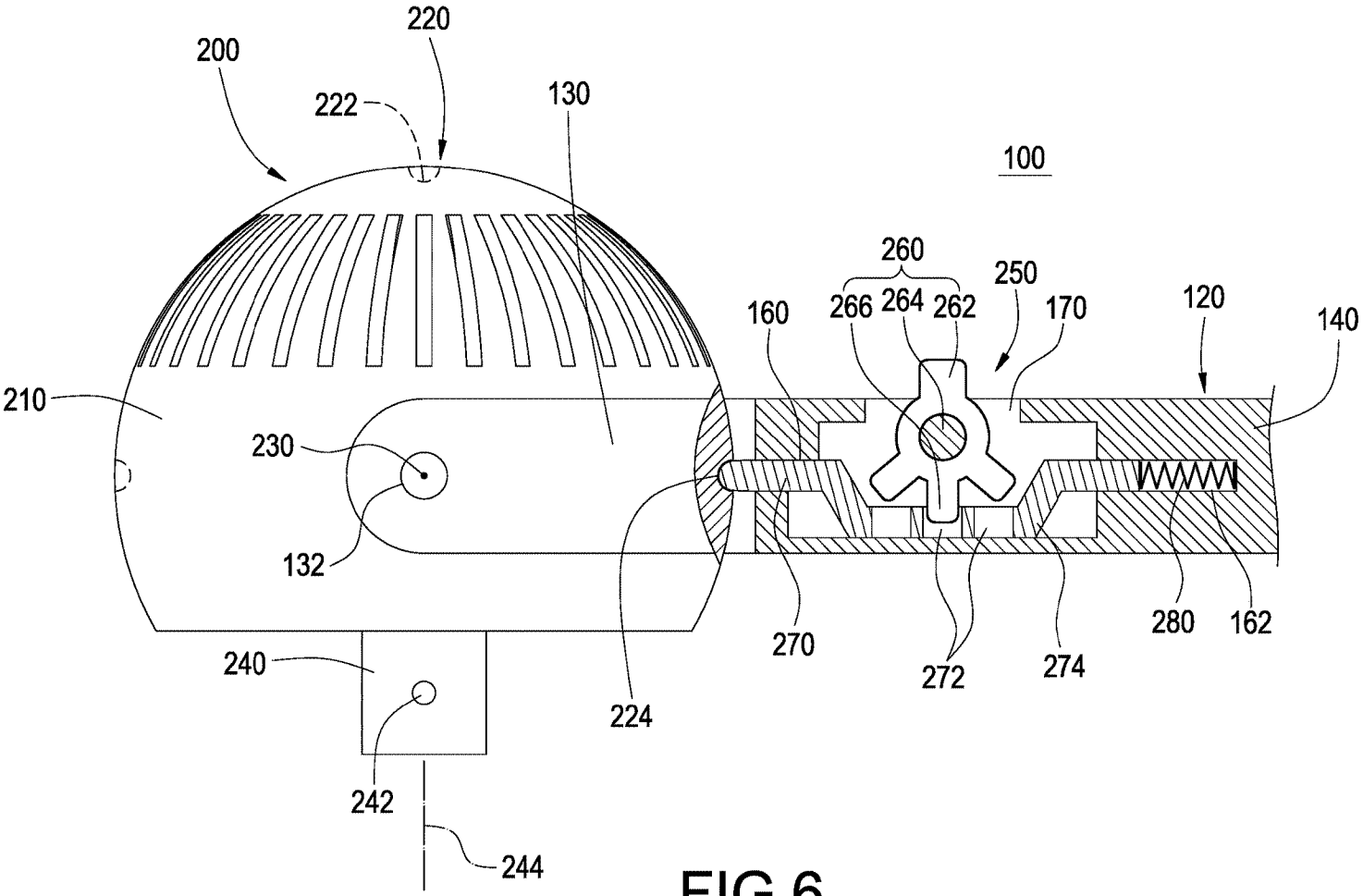
FIG. 6 is a cross-sectional view of FIG. 5.

In the embodiment shown in FIGS. 2, 4, and 6, the drive bar 120 further includes an accommodating recess 162 in communication with the radial hole 170, and the accommodating recess 162 receives the locking spring 280 and is disposed corresponding to the axial hole 160. The accommodating recess 162 also provides a space for receiving the latch element 270 during its movement, and thus a size of the radial hole 170 can be reduced to prevent the strength or operation quality of the drive bar 120 from being compromised. The accommodating recess 162 can be formed in the enlarged end 140 or the bar body 142, varying depending on requirement.

The radial hole 170 is preferably a blind hole, and the latch element 270 includes a bend portion 274, so that the latch element 270 is axially movable along a bottom of the blind hole by means of the bend portion 274, thereby enhancing stability and reliability of the latch element 270 during its movement. However, in other different embodiment, the latch element 270 can axially move in a straight line in the axial hole 160 and the accommodating recess 162.

Figure 7:
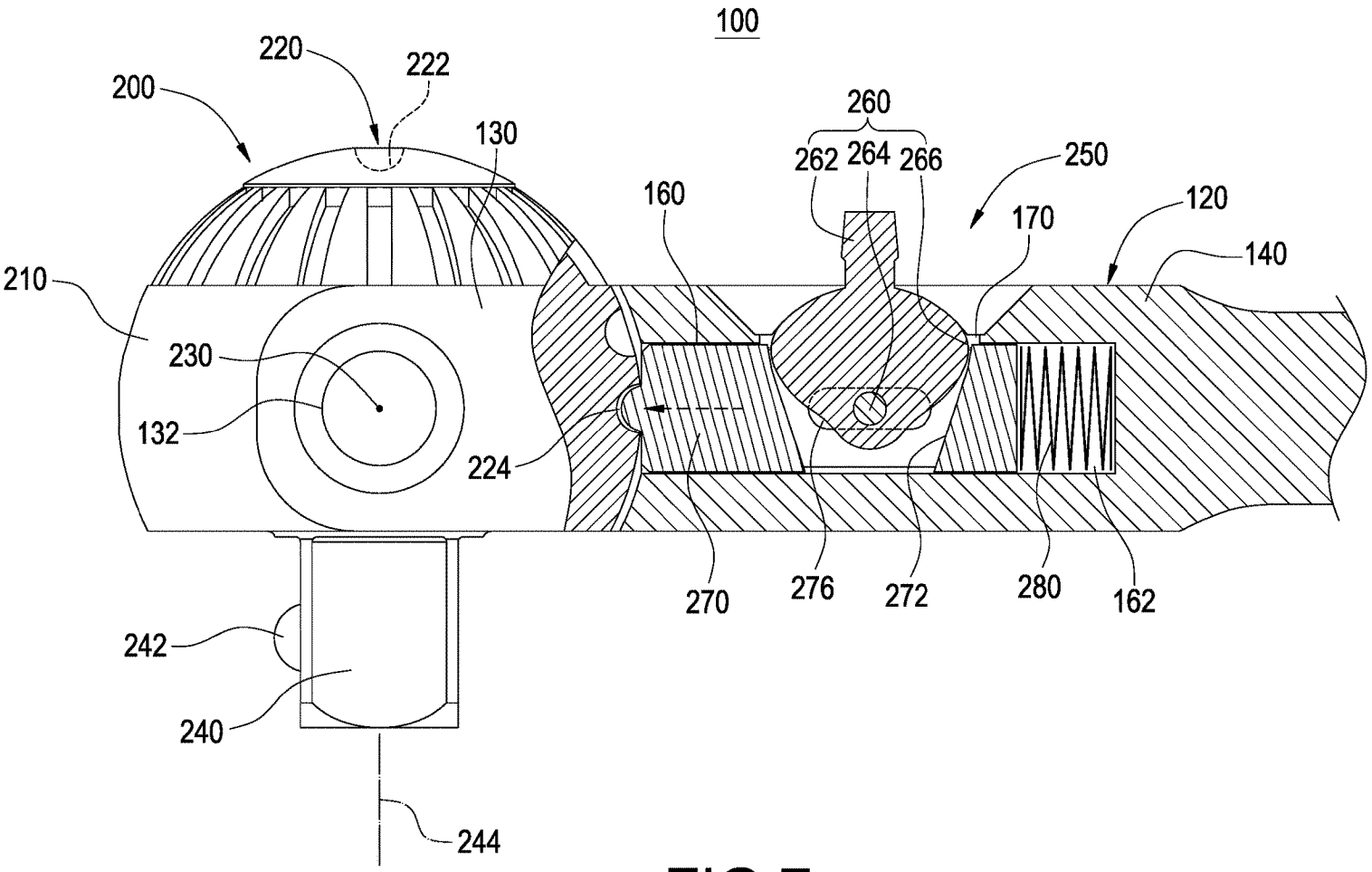
FIG. 7 is a cross-sectional view according to a second preferable embodiment of the present invention.
Figure 8:
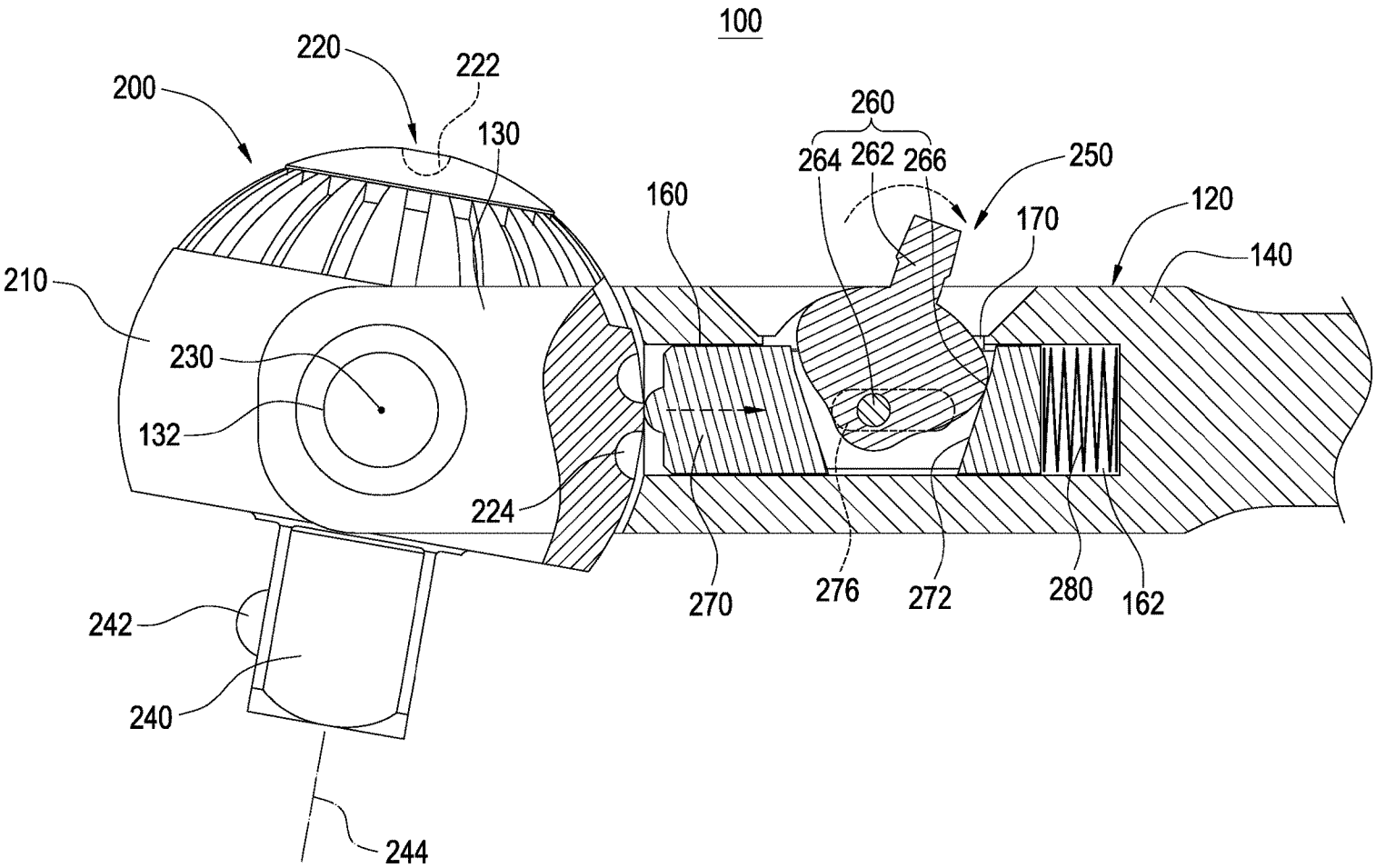
FIG. 8 is another cross-sectional view according to the second preferable embodiment of the present invention.
Figure 9:
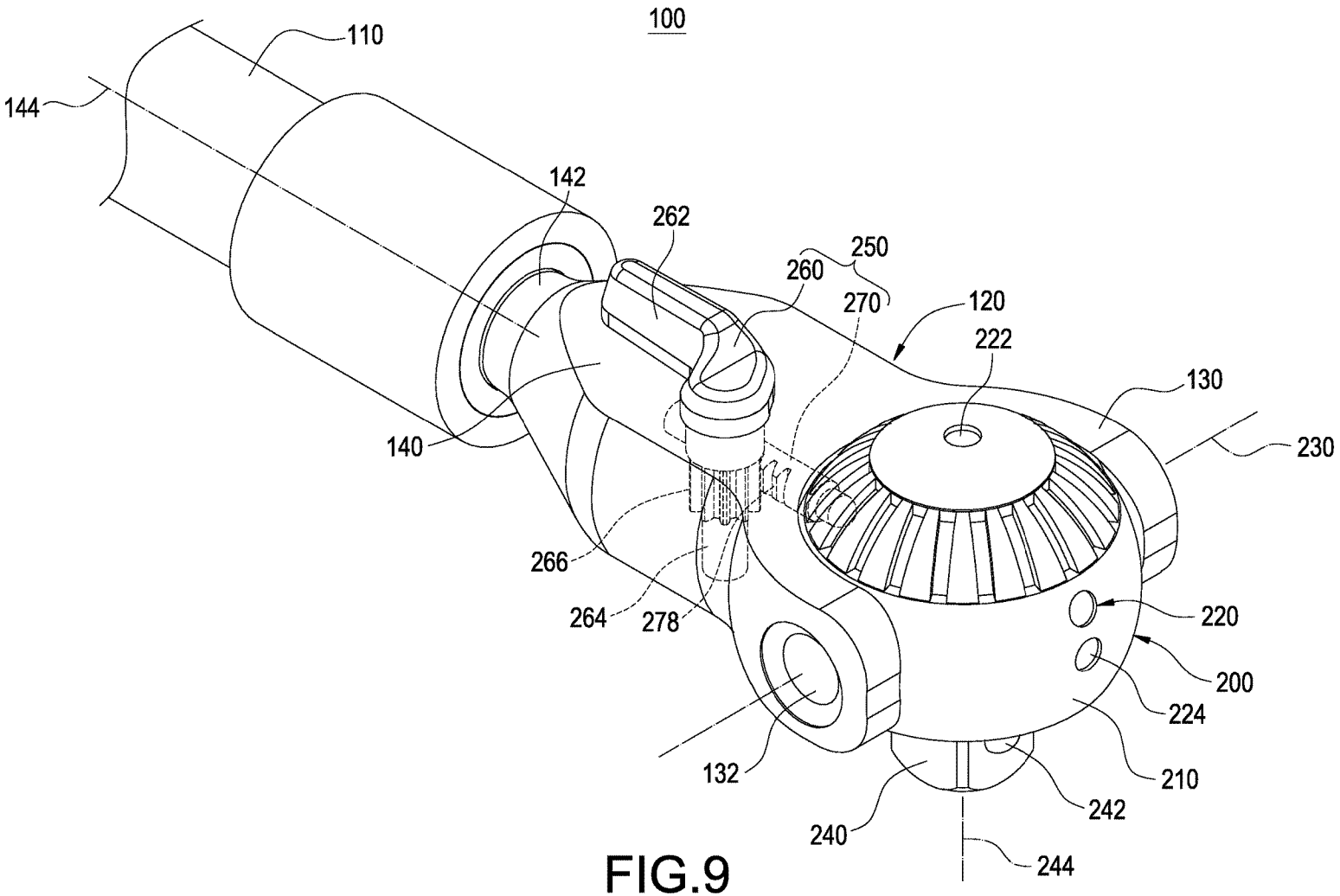
FIG. 9 is a partial perspective view according to a third preferable embodiment of the present invention.

Referring to FIGS. 7 and 8, one side of the axial hole 160 is preferably parallel to the bottom of the radial hole 170 (i.e. the blind hole), so that the latch element 270 is axially movable along the axial hole 160, the bottom of the radial hole 170, and the accommodating recess 162. As a result, the latch element 270 in the embodiment has better structural strength, stability and reliability.

The turning element 260 includes a button 262 protruding out of the radial hole 170, a fixing axle 264 pivotally connected to the drive bar 120, and a drive portion 266 driving movement of the latch element 270. The latch element 270 includes an opening 272 for insertion of the drive portion 266. In the first preferable embodiment, several openings 272 are formed in the bend portion 274, wherein the number of the openings 272 is corresponding to and the same as the number of the drive portions 266. When the turning element 260 is rotated, each drive portion 266 is inserted into each opening 272, so as to drive the latch element 270 to move axially.

However, in a second preferable embodiment shown in FIGS. 7 and 8, the latch element 270 can include a single opening 272, and the opening 272 is preferably a tapered opening. A cross section of the turning element 260 is similar to a spade shape or a cam shape. The drive portion 266 is disposed at two sides of the turning element 260, and the drive portion 266 is in contact with a side surface of the opening 272. Therefore, when the user moves the button 262 toward the bar body 142, the drive portion 266 drives the latch element 270 to move axially to be released from the positioning recess 220, so as to quickly release the rotary head 200. Furthermore, the fixing axle 264 of the turning element 260 is disposed on an axial movement direction of the latch element 270, so the turning element 260 forms a lateral hole 276 to prevent the latch element 270 from colliding with the fixing axle 264 when the latch element 270 moves axially.

Referring to FIGS. 9 to 12 showing a third embodiment, the third embodiment employs a driving method similar to motion transfer between a gears and a rack. In other words, the drive portion 266 of the turning element 260 is a plurality of tooth portions, and the latch element 270 includes a plurality of engagement portions 278 corresponding to the tooth portions. Each tooth portion rotatably drives each engagement portion 278 so as to drive axial movement of the latch element 270. The tooth portions are preferably circularly arranged on a circumferential surface of the fixing axle 264, and are disposed on a middle portion of the fixing axle 264. The fixing axle 264 coaxially extends from one side of the tooth portions to be pivotally connected to the radial hole 170, so that the button 262 is rotatable about the fixing axle 264 to rotate the tooth portions.

Figure 10:
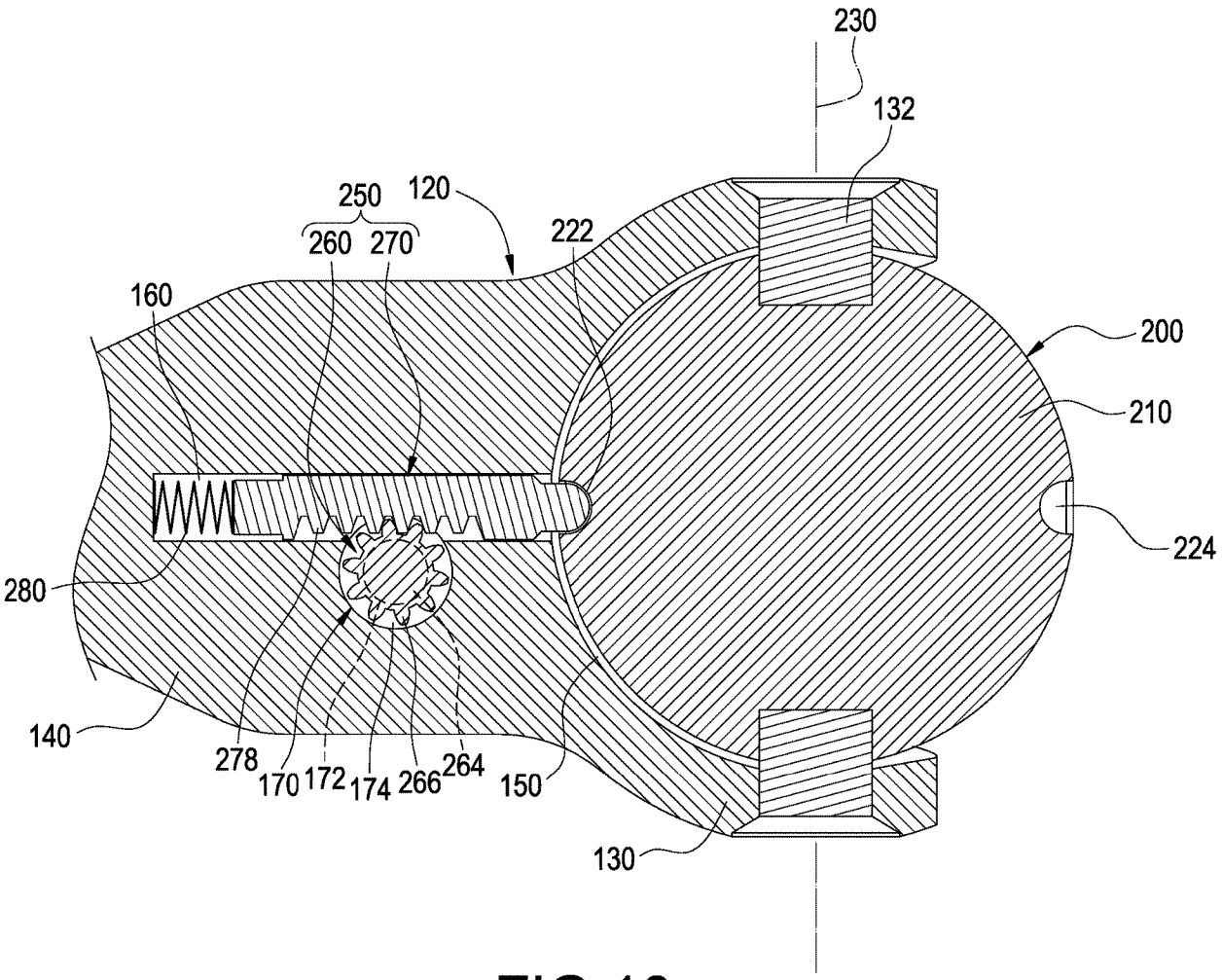
FIG. 10 is a partial cross-sectional view according to the third preferable embodiment of the present invention.
Figure 12:
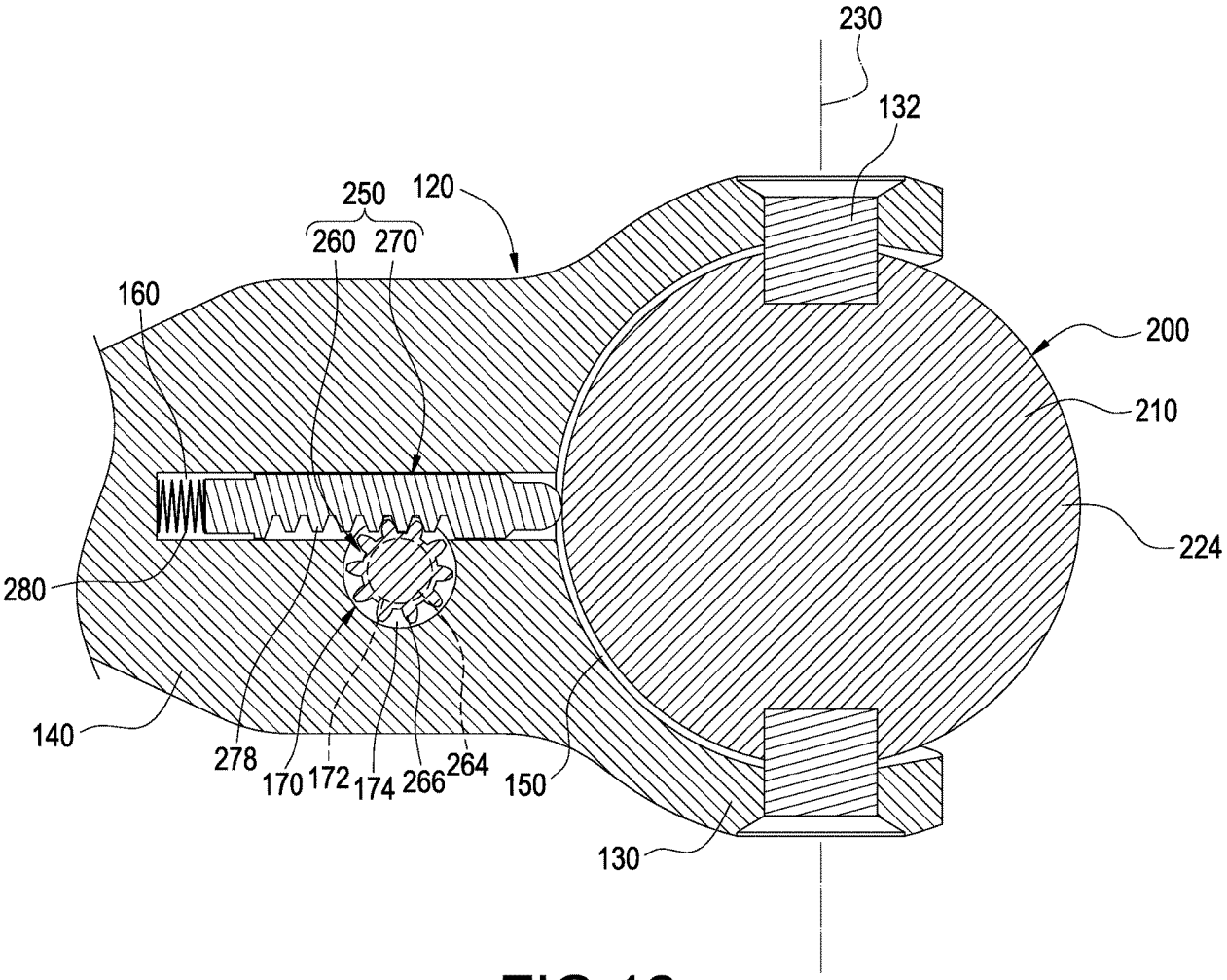
FIG. 12 is another partial cross-sectional view according to the third preferable embodiment of the present invention.

Referring to FIGS. 10 and 12, the radial hole 170 further includes a first hole 172 and a second hole 174 in communication with the first hole 172. The first hole 172 has a smaller diameter than a diameter of the second hole 174. The fixing axle 264 is pivotally connected to the first hole 172, and the second hole 174 communicates with the axial hole 160.

How to operate the ratchet wrench 100 having the quick release structure is more fully detailed as follows. As shown in FIGS. 1, 2, 7, 9, and 10, when the turning element 260 of the locking switch 250 is not rotated/moved, the latch element 270 protrudes out of the fork opening 150 under the action of an elastic force of the locking spring 280 to be engaged with the first positioning recess 222 (as in the first embodiment) or the second positioning recess 224 (as in the second embodiment) of the rotary head 200. At this point, the locking switch 250 is in a middle position and is in a locked state/position, wherein the locking spring 280 is in a stretched state.

Figure 3:
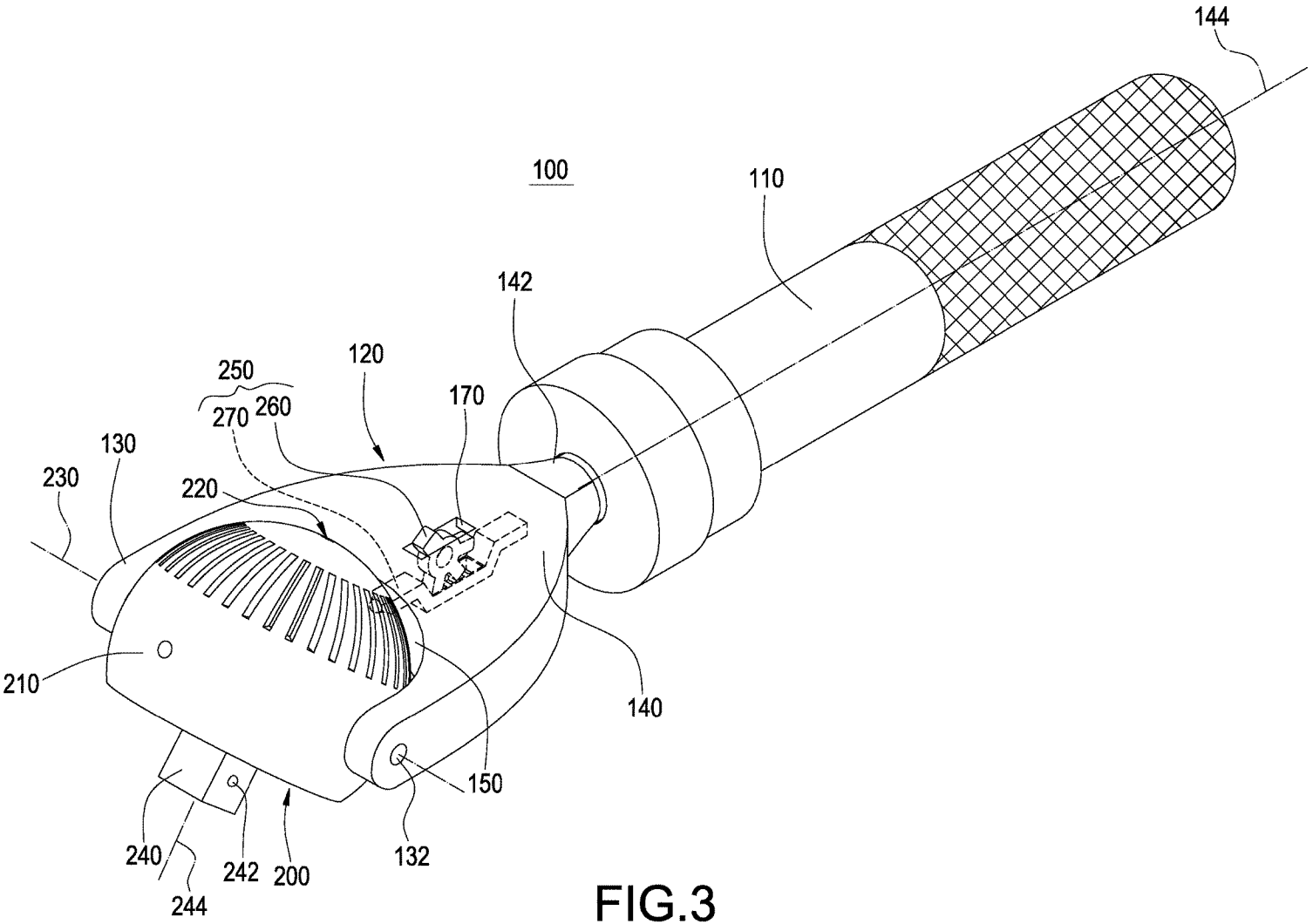
FIG. 3 is another perspective view according to the first preferable embodiment of the present invention.

As shown in FIGS. 3 and 4, when the button 262 of the turning element 260 is rotated toward the rotary head 200, each drive portion 266 rotates about the fixing axle 264 to drive the latch element 270 to move toward the accommodating recess 162 until the latch element 270 is released from the first positioning recess 222 (as in the first embodiment). However, in the embodiment shown in FIG. 8, the button 262 of the turning element 260 rotates toward the bar body 142, and then the latch element 270 is released from the second positioning recess 224 (as in the second embodiment).

Figure 11:
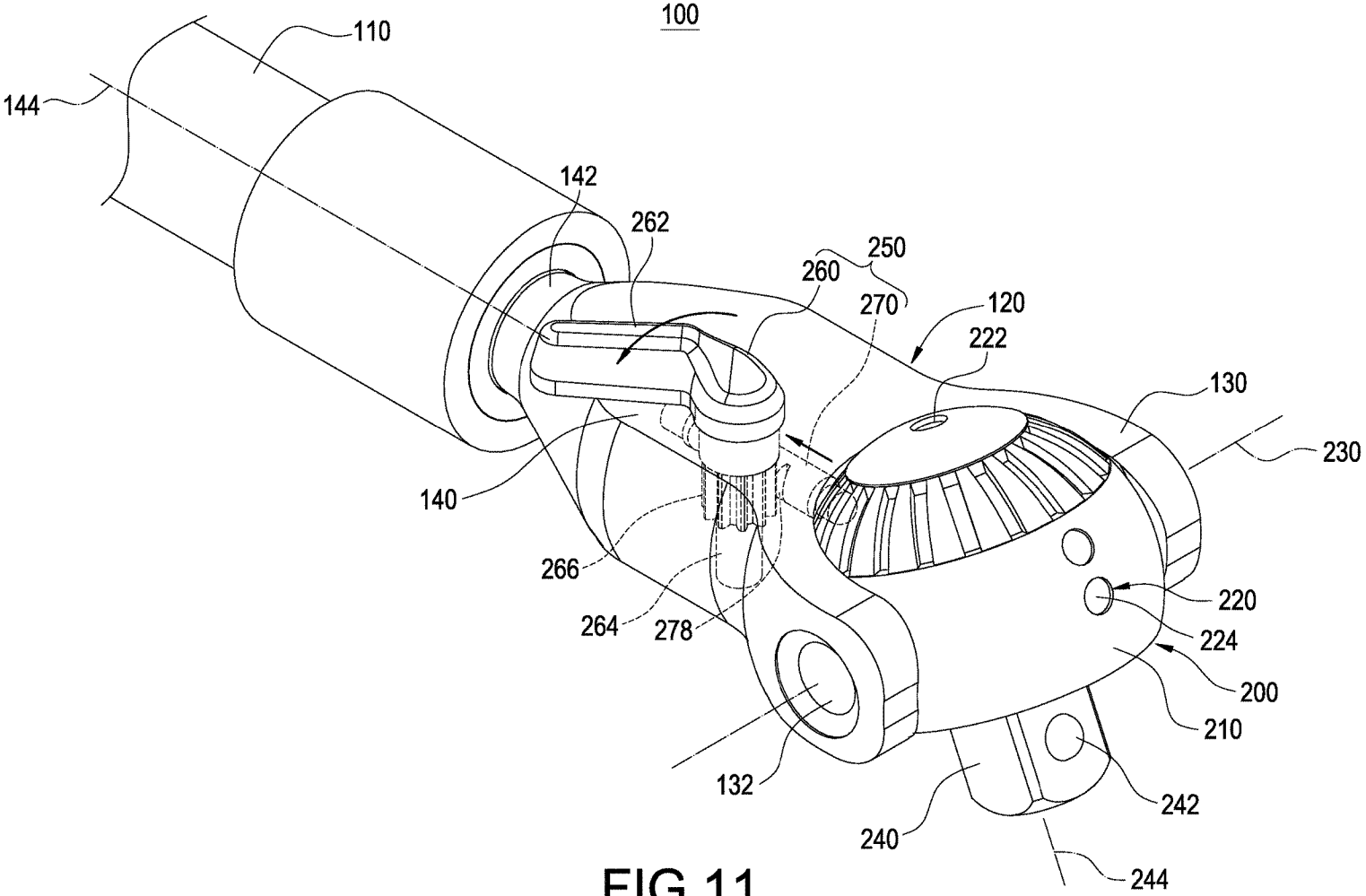
FIG. 11 is another partial perspective view according to the third preferable embodiment of the present invention.

In the third embodiment shown in FIGS. 11 and 12, when the button 262 rotates in a direction away from the axial hole 160, the tooth portions drive the engagement portions 278 to move toward the bar body 142, so that the latch element 270 is released from the second positioning recess 224, and the rotary head 200 is rotatable about the pivot axis 230. At this point, the locking switch 250 is in a released state/position, and the locking spring 280 is in a compressed state. When the locking switch 250 is in the released state, the user can rotate the rotary head 200 freely until the rotary head 200 is rotated to a desired angle as shown in FIGS. 5, 6, 8 or 11. When the turning element 260 of the locking switch 250 is released, the locking spring 280 recoils and automatically drives the latch element 270 to protrude outwardly toward the rotary head 200, so the latch element 270 can be again engaged with the second positioning recess 224 (as in the first embodiment) or any of the positioning recesses 220 of the rotary head 200.

By rotating/moving the turning element 260 of the locking switch 250 by a small angle, the rotary head 200 can be released quickly. As a result, the locking switch 250 is easy to operate and has a simple structure. Furthermore, by rotating/moving the button 262 of the turning element 260, the rotary head 200 is rotated to the desired positioning recess 222, 224 (i.e. a work angle of the output element 240), and then the button 262 is released, and as a result, a purpose of quickly releasing and positioning the rotary head 200 can be achieved.

Moreover, the locking switch 250 can selectively be disposed with the locking spring 280. For example, the locking spring 280 in the first, the second, and the third embodiments can automatically drive movement of the latch element 270 and fasten the rotary head 200 to keep it in the locked state. At this point, the button 262 of the turning element 260 automatically returns to its original position, e.g. a central position. Thus, the locking switch 250 in the present embodiment is kept in a normal close state without the necessity of additional operations, so the rotary head 200 is kept locked in the locked state against free rotation, thereby achieving safety and convenience in operations.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A ratchet wrench having a quick release structure, comprising:

a drive bar, the drive bar including a fork arm, a fork opening formed at the fork arm, an axial hole communicating with the fork opening, and a radial hole communicating with the axial hole;

a rotary head, the rotary head being pivotally connected to two ends of the fork arm, the rotary head including a round housing, a ratchet apparatus disposed inside the round housing, a plurality of positioning recesses disposed on the round housing, and a pivot axis formed at the rotary head and passing through the two ends of the fork arm, wherein the pivot axis is perpendicular to the radial hole; and a locking switch, the locking switch including a turning element disposed in the radial hole and a latch element disposed in the axial hole, the turning element rotatably driving the latch element to move axially, the latch element being engaged with or released from any of the positioning recesses, wherein the locking switch further includes a locking spring connected to one end of the latch element;

wherein the turning element includes a plurality of drive portions radially protruding therefrom and driving movement of the latch element;

wherein the latch element includes a plurality of openings for insertion of the drive portions, and wherein a quantity of the drive portions is the same as a quantity of the openings.

2. The ratchet wrench having the quick release structure of claim 1, wherein the other end of the latch element is axially movable with respect to the locking spring to be engaged with or released from any of the positioning recesses.

3. The ratchet wrench having the quick release structure of claim 2, wherein the drive bar further includes an accommodating recess communicating with the radial hole, and the accommodating recess receives the locking spring and is disposed corresponding to the axial hole.

4. The ratchet wrench having the quick release structure of claim 1, wherein the radial hole is a blind hole, and the latch element is axially movable along a bottom of the blind hole.

5. The ratchet wrench having the quick release structure of claim 4, wherein the latch element includes a bend portion in contact with the bottom of the blind hole.

6. The ratchet wrench having the quick release structure of claim 4, wherein one side of the axial hole is parallel to the bottom of the blind hole.

7. The ratchet wrench having the quick release structure of claim 1, wherein the turning element further includes a button protruding out of the radial hole and a fixing axle pivotally connected to the drive bar.

8. The ratchet wrench having the quick release structure of claim 7, wherein the latch element includes a lateral hole disposed corresponding to the fixing axle.

9. The ratchet wrench having the quick release structure of claim 7, wherein the drive portion is a plurality of tooth portions, and the latch element is a plurality of engagement portions corresponding to the tooth portions.

10. The ratchet wrench having the quick release structure of claim 7, wherein the radial hole includes a first hole and a second hole in communication with the first hole, the fixing axle is pivotally connected to the first hole, and the second hole communicates with the axial hole.

11. The ratchet wrench having the quick release structure of claim 9, wherein the tooth portions are circularly arranged on a circumferential surface of the fixing axle, and are disposed on a middle portion of the fixing axle.

12. The ratchet wrench having the quick release structure of claim 1, wherein the drive bar further includes an enlarged end and a bar body, the enlarged end is disposed between the fork arm and the bar body, and the axial hole and the radial hole are both disposed in the enlarged end.

13. The ratchet wrench having the quick release structure of claim 1, wherein the positioning recesses at least include a first positioning recess disposed on a top of the round housing and a second positioning recess disposed on a side surface of the round housing.

14. The ratchet wrench having the quick release structure of claim 13, wherein the first positioning recess and the second positioning recess form an included angle of 90 degrees therebetween.

* * * * *